US007737909B2

(12) United States Patent
Pan

(10) Patent No.: US 7,737,909 B2
(45) Date of Patent: Jun. 15, 2010

(54) ANTENNA STRUCTURE FOR TWO OVERLAPPING FREQUENCY BANDS

(75) Inventor: Sheng-Gen Pan, Kamp-Lintfort (DE)

(73) Assignee: Palm, Inc., Sunnyvale, CA (US)

( * ) Notice: Subject to any disclaimer, the term of this patent is extended or adjusted under 35 U.S.C. 154(b) by 493 days.

(21) Appl. No.: 10/539,665

(22) PCT Filed: Nov. 18, 2003

(86) PCT No.: PCT/DE03/03821

§ 371 (c)(1),
(2), (4) Date: Jun. 14, 2005

(87) PCT Pub. No.: WO2004/054036

PCT Pub. Date: Jun. 24, 2004

(65) Prior Publication Data

US 2006/0152429 A1 Jul. 13, 2006

(30) Foreign Application Priority Data

Dec. 12, 2002 (DE) ..... 102 58 184

(51) Int. Cl.
*H01Q 1/36* (2006.01)

(52) U.S. Cl. ..... 343/895; 343/700 MS

(58) Field of Classification Search ..... 343/895, 343/700 MS

See application file for complete search history.

(56) References Cited

U.S. PATENT DOCUMENTS

| | | | | |
|---|---|---|---|---|
| 4,835,538 | A | 5/1989 | McKenna et al. | 343/700 MS |
| 5,966,097 | A | 10/1999 | Fukasawa et al. | 343/700 MS |
| 6,320,545 | B1 | 11/2001 | Nagumo et al. | 343/700 MS |
| 6,639,555 | B1 * | 10/2003 | Kane et al. | 343/700 MS |

FOREIGN PATENT DOCUMENTS

| | | |
|---|---|---|
| AU | 55898 73 | 11/1974 |
| DE | 37 86 913 T2 | 8/1988 |
| DE | 44 23 191 | 1/1996 |
| DE | 197 20 773 | 2/1998 |
| EP | 0 279 050 | 8/1988 |
| EP | 0 884 796 | 12/1998 |
| EP | 1 198 026 | 4/2002 |
| EP | 1 376 761 | 1/2004 |
| WO | WO 99/22420 | 5/1999 |
| WO | WO 02/075853 | 9/2002 |

* cited by examiner

*Primary Examiner*—Douglas W Owens
*Assistant Examiner*—Dieu Hien T Duong
(74) *Attorney, Agent, or Firm*—K&L Gates LLP

(57) ABSTRACT

The present disclosure relates to a substantially flat antenna structure which includes a frame earth terminal and at least one HF feed connection, which can be used for at least two frequency bands. From one foot area outwards, which includes the frame earth terminal, the antenna structure includes two antenna branches. Two distanced HF feed connections are provided in the foot area. The two antenna branches of the antenna structure are embodied in such a way that the associated frequency bands overlap.

5 Claims, 2 Drawing Sheets

ANTENNA STRUCTURE FOR TWO OVERLAPPING FREQUENCY BANDS

This application is a National Stage application of PCT application No. PCT/DE03//03821 filed 18 Nov. 2003.

FIELD OF TECHNOLOGY

The present disclosure relates to an antenna structure of an substantially flat form having a ground connection and at least one RF supply connection, which is designed for use for at least two frequency bands.

BACKGROUND

Antenna structures which are referred to by the expression "dual-band antennas" are known, for example, from the mobile radio field. Dual-band antennas such as these are designed to be suitable for transmission and reception within two mobile radio standard frequency bands which are separated from one another. One typical example is a dual-band antenna which can be used for the GSM 900 and GSM 1800 mobile radio standard frequency ranges. These two frequency bands do not overlap one another. In fact, the resultant antenna matching systems are in each case concentrated around the relevant mid-frequencies of the standard mobile radio frequency ranges. The dual-band antenna therefore has a high reactance in the vicinity of its resonant frequencies.

Two additional standard frequency ranges are of major importance in mobile radio technology and are used in particular in the US American area. These are the EGSM 900 and EGSM 1900 mobile radio standard frequency ranges. As is known in the art, the frequency bands of the GSM 850 and EGSM 900 standards and of the GSM 1800 and EGSM 1900 standards are each arranged adjacent to one another in the frequency spectrum. In this context, trials have already been carried out to develop comparatively broadband antennas for such adjacent mobile radio standard frequency ranges. In the field of internal antennas, that is to say antennas which are accommodated within a mobile radio housing, the following solution approaches for broadband antennas have already been investigated:

The antenna volume can be enlarged so as to produce broadband resonances. However, this has the disadvantage that more space must actually be provided for the antenna volume within a cellular telephone.

WO 01/82412 A1, for example, discloses multilayer internal antennas with a stacked structure with so-called "parasitic" antenna elements being arranged above and/or below a main antenna element and being electromagnetically coupled to the main antenna element, although they do not have their own RF supply connection. In order to reduce coupling so as to achieve broader antenna matching, long distances are required between the antenna elements, or the antenna elements have to be quite thick. Overall, an antenna structure such as this occupies quite a large volume, and this is actually undesirable for internal antennas for cellular telephones.

Furthermore, U.S. Pat. No. 6,166,694 discloses an antenna structure for two resonant frequencies, that is to say for two frequency ranges, which has a single RF supply connection. The two frequency bands of the antenna structure described there cannot be overlapped.

EP 0 884 796 A2 discloses an antenna structure which is formed from bent or curved separations of a linear conductor. The antenna structures proposed there are all excited by a single RF supply line.

EP 1 376 761 A1 likewise describes antenna structures with broad antenna matching, which are excited via a single RF supply line.

Against this background, the present disclosure is based on developing an antenna structure of the type mentioned above such that it requires a small antenna volume, while the two frequency bands have a suitable overlap.

BRIEF SUMMARY

An antenna structure is disclosed under an exemplary embodiment, having a substantially flat form with a ground connection and at least one RF supply connection, which is designed for use for at least two frequency bands. The exemplary antenna structure has two antenna branches from a foot area which surrounds the ground connection, two RF supply connections, which are arranged at a distance from one another, are provided in the foot area, and the two antenna branches of the antenna structure are designed such that their associated frequency bands overlap.

The broadband nature of the antenna structure that is provided is thus based on the provision of two RF supply connections that are arranged at a distance from one another and whose exact position on the foot point can be adjusted so as to achieve a suitable overlap between the two frequency bands. The actual form of the antenna branches of the antenna structure can be chosen as required, although it is necessary to take account of the constraint that the respective antenna branch is designed suitably for one resonant frequency that is associated with it and defines its frequency range. A desired overlap of the two frequency bands can be achieved by appropriate arrangement of the two RF supply connections.

The antenna structure may be used as an internal antenna for cellular telephones. In particular, the antenna structure may be in the form of a planar, inverted F structure (PIFA).

The antenna structure is distinguished by having a particularly small volume when the two antenna branches of the antenna structure are each designed in a meandering shape. In this case, the antenna branches may be arranged alongside one another, so that the two meandering antenna branches each define an associated antenna surface, with the two resultant antenna surfaces being at a distance from one another. In one particularly space-saving embodiment, the two antenna branches may be in the form of a double meander, in which the respective meander of one antenna branch engages in the meander of the other antenna branch, so that the two antenna branches essentially run parallel to one another.

The distance between the two meandering antenna branches is preferably in the range between 0.5 and 10 mm under an embodiment, which likewise lead to a volume-saving antenna structure which can be used as an internal antenna structure for cellular telephones.

The distance between the two RF supply connections is preferably in the range from 5 to 30 mm under an embodiment, with the location of the RF supply connections and their distance from one another and to the ground connection each being matched to the desired frequency bands for the two antenna branches.

In addition to the two antenna branches which act as transmitting elements and receiving elements, the antenna structure may have an excitation circuit with an RF supply line, which branches to the two RF supply connections. This results in the same excitation signal at both RF supply connections.

In one preferred embodiment, the antenna structure is designed for the GSM 850 and EGSM 900 mobile radio standard frequency ranges, with the two overlapping frequency ranges resulting in a broadband spectrum which covers the two standard frequency ranges. A design is also possible for the GSM 1800 and EGSM 1900 mobile radio standard frequency ranges, in which case the dimensions of the antenna branches must be adapted.

The compact physical form of the antenna structure ensures that it requires a volume of only about 3 to 5 cm3, which is considerably less than the normal value until now for internal mobile radio antennas.

BRIEF DESCRIPTION OF THE DRAWINGS

Exemplary embodiments of the invention will be explained in more detail in the following text with reference to the drawing figures, with components which functionally correspond to one another being annotated with the same reference symbols in the drawing figures. In the figures.

DETAILED DESCRIPTION

Figure 1:
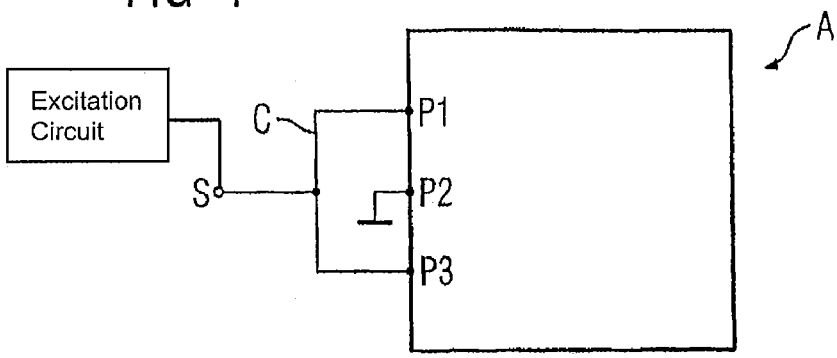
FIG. 1 shows a schematic overview illustration of a general antenna structure.

FIG. 1 shows, in a schematic manner, the general design of an antenna structure, which is designed to transmit and receive in the region of two mutually adjacent mobile radio standard frequency ranges. The reference symbol "A" in FIG. 1 generally indicates the antenna surface area which is occupied by elements of the antenna structure which are relevant for radiation. Two RF supply connections P1, P3, between which a ground connection P2 is provided, are located in a foot area F of the antenna structure. The two RF supply connections P1, P3 are connected to a connecting point S for an RF signal, from which an excitation circuit supply line C branches off to the RF supply connections P1, P3.

The distance between the two RF supply points P1, P3 which are arranged in the foot area F is in the range between 5 and 30 mm in the disclosed embodiment. Similarly, the distance between the antenna surface A and a baseplate (not illustrated) which runs essentially parallel to the antenna surface A is in the range between 4 and 7 mm.

The general exemplary embodiment of an antenna structure illustrated in FIG. 1 is a PIFA antenna structure that is known per se, that is to say the illustrated structure is covered by the generic term that has been mentioned.

Figure 2:
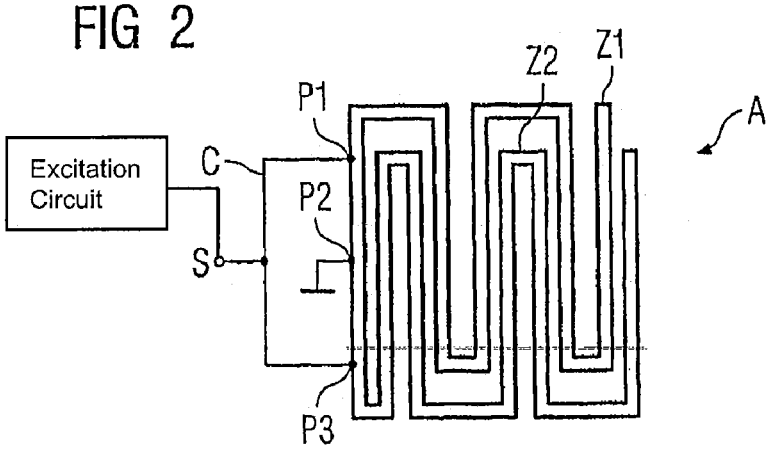
FIG. 2 shows a schematic illustration of a first embodiment of the antenna structure shown in FIG. 1.

FIG. 2 shows a structure of the antenna surface A in detail. From the foot area F, the antenna structure has two antenna branches Z1, Z2 which each have a meandering shape and engage in one another, thus resulting in the external shape of a double meander. This external shape of the two antenna branches Z1, Z2 leads overall to the antenna structure having a small volume. The associated volume under the embodiment therefore, has exemplary edge lengths of 3.6 cm (width), 1.8 cm (length) and 0.6 cm (height). The exemplary width of the two antenna branches Z1, Z2 is 2 mm, while the exemplary distance between the two antenna branches Z1, Z2 is chosen to be 4 mm (distance between centers). The lengths of the two meandering antenna branches Z1, Z2 are preferably 98 mm and 86 mm, with respect to the ground connection P2. These lengths correspond to a value of lambda/4 for the respective mid-wavelengths of the two associated frequency ranges, one of which relates to the GSM 850 mobile radio standard, and the other relates to the EGSM 900 mobile radio standard frequency range.

The distance between the RF supply connection P1 and the ground connection P2 for the antenna structure shown in FIG. 2 is preferably 6 mm, while the distance between the RF supply connection P3 and the ground connection P2 is preferably 4 mm. The line C which connects the two RF supply connections P1, P3 to one another preferably has a length of 14 mm. The line C is arranged in the normal manner on the baseplate, so that the resultant two ends of the line C are connected to the RF supply connections P1, P3 via contact springs (not illustrated). The contact springs have a length of about 6 to 7 mm for the exemplary embodiment shown in FIG. 2.

In general, the distance between the electromagnetically coupled, meandering antenna branches Z1, Z2 is preferably in the range from 0.5 to 10 mm. This also applies to the embodiment of an antenna structure as shown in FIGS. 4 and 5, which will be explained later.

Figure 3:
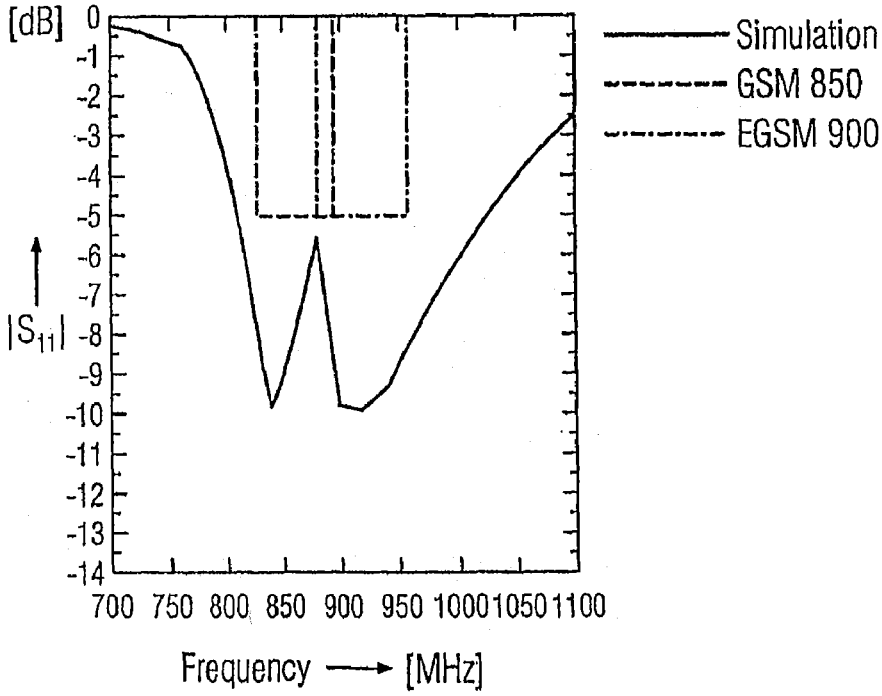
FIG. 3 shows antenna matching for the antenna structure shown in FIG. 2.

FIG. 3 shows matching of the antenna structure that has been explained with reference to FIG. 2, in which case there is a calculated relationship between a reflection coefficient S11 and a frequency. The two standard mobile radio frequency ranges for GSM 850 and EGSM 900 which are relevant here are each indicated by dashed lines in FIG. 3. As can be seen, the antenna structure in FIG. 2 with coupled, meandering antenna branches Z1, Z2 which engage in one another has a broadband spectrum, with the minimum reflection coefficient occurring at about 6 dB. A frequency profile such as this for the reflection coefficient S11 is satisfactory in its own right for the requirements in the mobile radio field.

Figure 4:
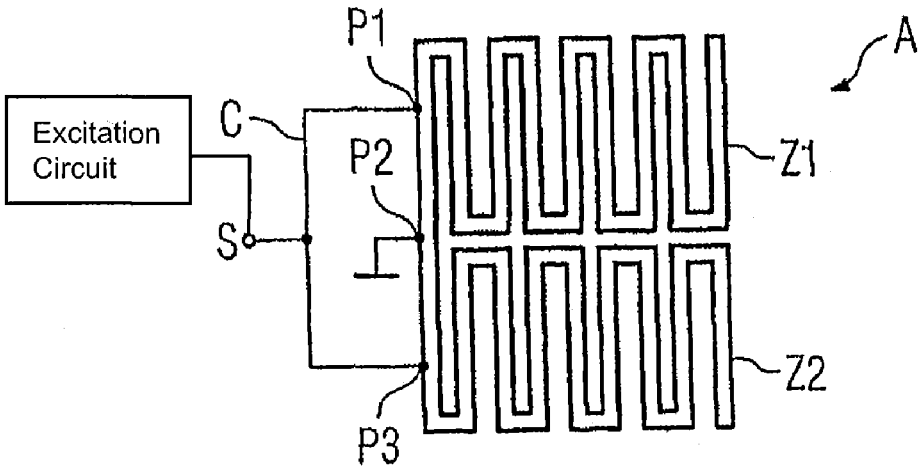
FIG. 4 shows another embodiment of the antenna structure shown in FIG. 1.
Figure 5:
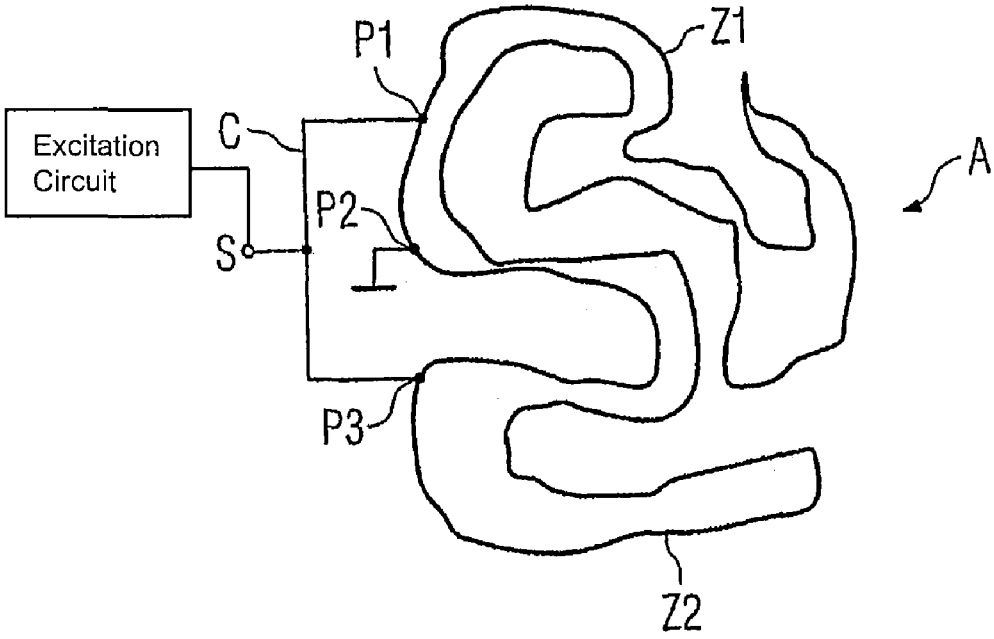
FIG. 5 shows a further embodiment of the antenna structure shown in FIG. 1.

FIG. 4 shows a further embodiment of an antenna structure in which the two antenna branches Z1, Z2 likewise have a meandering shape, but are arranged alongside one another, in contrast to the embodiment shown in FIG. 2. The antenna structure shown in FIG. 4 requires somewhat more volume, but can be produced more easily and can also be adjusted more easily than the structure shown in FIG. 2. In this case, the positions of the RF supply points P1, P3 are varied during adjustment of the antenna structure for a suitable overlap of the two frequency ranges.

The distance between the two antenna branches Z1, Z2 in the antenna structure shown in FIG. 4 is preferably between 0.5 and 10 mm, with this distance being defined as the shortest distance between the two antenna branches Z1, Z2. The antenna structure shown in FIG. 4 requires a volume of 4.5 cm3, compared with the antenna structure shown in FIG. 2 (3.9 cm3), which corresponds to edge lengths of 3.6 cm (width), 2.1 cm (length) and 0.6 cm (height).

FIG. 5 shows a further antenna structure, which is common to the antenna structures shown in FIGS. 2 and 4, in that the two RF supply connections P3, P1 which are provided at a distance from one another are present, with the line C also being present in the same form as in the embodiments shown in FIGS. 2 and 4. The antenna structure likewise has the two antenna branches Z1, Z2, whose widths vary over their length and which are electromagnetically coupled. It is also possible in the case of the antenna structure shown here to achieve overlapping frequency ranges of the two antenna branches Z1, Z2 by suitable choice of the positions for the connecting points P1, P2, P3.

It should be noted that the exemplary embodiments described here relate to the mutually adjacent standard mobile radio frequency ranges for GSM 850 and EGSM 900. The exemplary embodiments can be transferred directly to antenna structures which are intended to have overlapping frequency ranges for the GSM 1800 and EGSM 1900 standard mobile radio frequency ranges.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claim is:

1. An antenna structure having a substantially flat form with a ground connection, which is designed for use for at least two frequency bands, comprising:

two transmitter/receiver antenna branches, which are electrically conductively connected to a foot area, wherein the foot area surrounds the ground connection;

two RF supply connections that are arranged at a distance from one another, provided in the foot area, between which the ground connection is provided, wherein the two transmitter/receiver antenna branches of the antenna structure are designed such that the two transmitter/receiver antenna branches are associated with overlapping frequency bands; and an excitation circuit with an RF supply line, which branches to the two RF supply connections;

wherein the two transmitter/receiver antenna branches act as transmitting elements and receiving elements.

2. The antenna structure as claimed in claim 1, wherein the antenna structure is a planar, inverted F structure.

3. The antenna structure as claimed in claim 1, wherein the two transmitter/receiver antenna branches of the antenna structure are each designed in a meandering shape.

4. The antenna structure as claimed in claim 3, wherein the two transmitter/receiver antenna branches are in the form of a double meander.

5. The antenna structure as claimed in claim 3, wherein the distance between the two meandering transmitter/receiver antenna branches is in the range between 0.5 and 10 mm.

* * * * *